US011479982B2

(12) United States Patent
Forrester et al.

(10) Patent No.: US 11,479,982 B2
(45) Date of Patent: Oct. 25, 2022

(54) ISOLATION POCKET FORM AND METHOD FOR MAKING CRACK RESISTANT CONCRETE SLABS

(71) Applicant: FORRESTER MANUFACTURING CO., INC., Suwanee, GA (US)

(72) Inventors: Joseph Forrester, Auburn, GA (US); Ryan Forrester, Hoschton, GA (US); Michael DeLoach, Bethlehem, GA (US)

(73) Assignee: Forrester Manufacturing Co., Inc., Suwanee, GA (US)

( * ) Notice: Subject to any disclaimer, the term of this patent is extended or adjusted under 35 U.S.C. 154(b) by 0 days.

(21) Appl. No.: 17/061,892

(22) Filed: Oct. 2, 2020

(65) Prior Publication Data

US 2021/0102391 A1 Apr. 8, 2021

Related U.S. Application Data

(60) Provisional application No. 62/910,833, filed on Oct. 4, 2019.

(51) Int. Cl.
*E04G 15/06* (2006.01)
*E04G 11/36* (2006.01)

(52) U.S. Cl.
CPC ..... *E04G 15/061* (2013.01); *E04G 11/36* (2013.01)

(58) Field of Classification Search
CPC ..... E04G 15/06; E04G 15/00; E04G 15/061; E04G 15/063; E04G 15/065; E04G 15/068; E04G 5/06; E04G 5/061; E04G 5/063
USPC ..... 264/31, 35; 249/184, 185; 52/741.14, 52/741.15
See application file for complete search history.

(56) References Cited

U.S. PATENT DOCUMENTS

| | | | | |
|---|---|---|---|---|
| 1,001,500 | A * | 8/1911 | Blayney | E04G 15/063 249/177 |
| 3,276,176 | A * | 10/1966 | Jonsson | E04G 15/061 52/309.2 |
| 5,032,197 | A * | 7/1991 | Trimble | E02D 29/121 156/71 |
| 5,224,313 | A * | 7/1993 | Guillebeau, III | E02D 27/425 52/295 |
| 6,786,463 | B1 * | 9/2004 | Collum | B28B 7/30 249/134 |
| 7,958,692 | B2 * | 6/2011 | George | E04F 17/06 52/745.2 |
| 9,915,064 | B1 * | 3/2018 | Sanders | E04G 17/02 |
| 10,145,131 | B2 * | 12/2018 | Hendricks | E04G 11/08 |
| 2004/0045241 | A1 * | 3/2004 | Guillebeau | E02D 27/42 52/378 |

(Continued)

FOREIGN PATENT DOCUMENTS

| | | | | |
|---|---|---|---|---|
| DE | 3700351 | A1 * | 7/1988 | E04G 15/063 |
| FR | 3013371 | A1 * | 5/2015 | B28B 7/186 |

(Continued)

*Primary Examiner* — Michael Safavi
(74) *Attorney, Agent, or Firm* — Finch & Maloney, PLLC

(57) ABSTRACT

A pocket isolator form, for placement around a footer before a concrete slab is poured, is formed from plural barrier sections. At least some of the sections are curved, so that a sharp re-entrant corned is not formed in the concrete slab. The curved sections may be assembled with straight sections to form barriers of various form shapes which avoid the creation of sharp re-entrant corners in the slab.

6 Claims, 9 Drawing Sheets

(56) References Cited

U.S. PATENT DOCUMENTS

| | | | | |
|---|---|---|---|---|
| 2007/0194205 | A1* | 8/2007 | Blackmon | E04G 15/063<br>249/185 |
| 2010/0132292 | A1* | 6/2010 | Gullette | E04G 15/061<br>52/378 |
| 2014/0208665 | A1* | 7/2014 | Kapitza | E04B 1/34331<br>52/123.1 |
| 2016/0201276 | A1* | 7/2016 | Ganey | E01C 19/4866<br>404/119 |
| 2020/0299980 | A1* | 9/2020 | McAuley | E04G 15/061 |

FOREIGN PATENT DOCUMENTS

| | | | | |
|---|---|---|---|---|
| FR | 3087464 | A1 * | 4/2020 | B28B 21/566 |
| WO | WO-2016194251 | A1 * | 12/2016 | C08L 101/12 |
| WO | WO-2017122793 | A1 * | 7/2017 | F16L 5/04 |

* cited by examiner

ISOLATION POCKET FORM AND METHOD FOR MAKING CRACK RESISTANT CONCRETE SLABS

TECHNICAL FIELD

This invention relates generally to commercial construction and more specifically to constructing concrete floor slabs for large commercial buildings.

BACKGROUND

Many large buildings, such as warehouses, shopping malls, big box stores, the like, are constructed with a superstructure that is supported at predetermined intervals by vertical steel support columns. The support columns are embedded at their bases within and extend upwardly from the concrete floor slab of the building. It is important that the bases of the columns be isolated from the concrete floor slab so that settlement or other movement of the columns does not transfer to the slab.

To accomplish this isolation, heavy concrete footings are cast in the ground at the prospective locations of the support columns. Anchor bolts are embedded in and project upwardly from the footings. When the footings have cured, the vertically extending steel support columns are mounted to the footings by means of the anchor bolts.

Before the floor slab is poured, isolation forms are attached to the footings surrounding the columns. Typically, the column footings are square or box-shaped. The floor of the building is then prepared by grading, leveling, and compacting aggregate material throughout the floor expanse to a predetermined depth to form a base. The aggregate is compacted around and against the exterior surfaces of the isolation forms leaving the interiors of the forms empty.

With the aggregate base prepared, the concrete floor slab is poured on top of the compacted aggregate up to the upper rims of the isolation forms. The isolation forms themselves may be filled at the same time or may be filled later after the floor slab has cured. The isolation forms typically are left in place within the concrete floor slab. Isolation pockets are thus formed in the floor slab around the bases of the support columns such that the column bases are isolated from the surrounding aggregate and concrete slab. Subsequent settlement or movement of the column and footing does not transfer to the slab. This insures a rigid and stable support for a building's superstructure.

Traditional concrete floor slabs inevitably tend to crack over time as a result of shrinkage of the concrete during the curing process, settlement, and other factors. Such cracks very often begin at the corners of square isolation pockets because stresses caused by slab movement are concentrated at these "re-entrant" corners, that is, at internal corners of the slab. Accordingly, crack control joints commonly are cut or scored in the concrete floor slab. The crack control joints connect the corners of each isolation pocket to the corners of surrounding isolation pockets. In this way, cracking of the floor slab generally occurs along the crack control joints where the cracks are not too visually objectionable.

Recently, improved concrete formulas have been developed that, when cured, produce a concrete slab that is highly resistant to cracking. These new concretes can be used to create concrete floor slabs that do not develop large cracks over time. While hairline cracks may appear, they are small and generally not objectionable. Accordingly, crack control joints are not needed when using these improved concretes. The result is a concrete floor slab with a pristine continuous top surface free of large cracks or crack control joints. Such a slab is preferred, especially for buildings such as grocery stores where the appearance of neatness and cleanliness is important. Jointless floor slabs are equally important in high volume distribution warehouses where the forklifts travel at high speeds and the roughness of the joint slows production.

Slab joints are notoriously high maintenance areas costing industry enormous amounts of time and money. Traditional square isolation pocket forms have been found less than suitable for use when pouring floor slabs using modern crack resistant concretes. Specifically, stresses in the floor slab still tend to become concentrated at the corners of the isolation pockets. The concrete of the slab is indeed resistant to cracking; however, the concentrated stresses at the isolation pocket corners still can initiate unsightly cracks in the floor slab at and around these corners. Since a crack resistant floor slab does not require crack control joints, these stress induced cracks can meander and result in unsightly areas around support columns and radiating out therefrom.

A need exists for a method and apparatus for constructing isolation pockets in floor slabs poured with crack resistant concrete that eliminates concentrated stresses at the isolation pockets and thus eliminate rogue cracks in the floor slab that begin at the isolation pockets. It is to the provision of such a method and apparatus that the present invention is primarily directed.

SUMMARY OF THE INVENTION

Briefly described, an isolation pocket form comprises at least one curved barrier section with a base and an upper edge. By "curved", we mean that the section has a non-linear horizontal cross-section. The curved section may have the shape of a circular arc (constant radius of curvature), as shown in the drawings, but that shape could be elliptical, or more generally, of varying finite curvature.

An array of support ribs is disposed around the curved barrier section and annular rings extend around the barrier section and connect the support ribs. The ribs and rings provide support and rigidity to the barrier section so that it does not tend to collapse or deform as concrete is poured around or into the isolation pocket form. One or more straight extension sections can be attached to the curved section(s) in order to accommodate varying sizes and configurations.

The isolation pocket form's barrier sections are preferably molded of an appropriate plastic material (examples of which are given further below) and has a surface that is smooth and somewhat slippery. The form may be fabricated in quarters or halves that can be connected together with appropriate fasteners into a continuous cylindrical configuration, or into various oblong racetrack shaped configurations.

Where pocket forms are to be placed near the exterior walls of the structure, the curved section(s) can be connected to linear extension(s) to accommodate interior corners, exterior corners, or "along-the-wall" scenarios. For example, at a footer location near an exterior corner of the structure, a 90° curved section may be assembled with a two straight extensions, one at either end of the curved section, forming an open pocket form configuration. The assembly is then placed with the two straight sections meeting the corner walls of the structure perpendicularly, while the curved section avoids the creation of a sharp "re-entrant" corner in the slab. Clips also may be attached around the base of the form for attaching the form to a poured concrete footing.

The method of the invention comprises pouring support post footings with embedded upwardly extending anchor bolts at predetermined intervals. An isolation pocket form according to the invention is assembled from barrier sections at each footing and is attached with clips or other fasteners. Support posts are anchored to the footings using the anchor bolts and nuts. The floor surrounding the isolation pocket forms is prepared by, for example, being graded, leveled, and covered with compacted aggregate. Crack resistant concrete is then pored over the compacted aggregate up to the rims of the isolation pocket forms and may be poured simultaneously into the isolation pocket forms surrounding the support posts. The crack resistant concrete cures to form a concrete slab floor with a top exposed surface that extends across the isolation pockets and to the support posts. Since the isolation pocket forms have curved sections, there are no sharp corners at the isolation pockets. Thus, stresses due to shrinkage or settlement of the slab do not tend to be concentrated at the isolation pockets. As a consequence, there are few instances of cracks in the slab surrounding the isolation pockets. Crack control joints are not needed, resulting in a clean floor slab that is smooth and clean looking. Should the column settle or otherwise move relative to the floor slab, such movement is accommodated by the in-situ isolation pocket forms and is not transferred to the floor slab causing it to crack.

These and other aspects, features, and advantages of the present invention will become more apparent from the detailed description below and the accompanying drawing figures, which are briefly described as follows.

DETAILED DESCRIPTION

Reference will now be made to the accompanying drawing figures, wherein like numerals indicate like parts throughout the several views.

Figure 1:
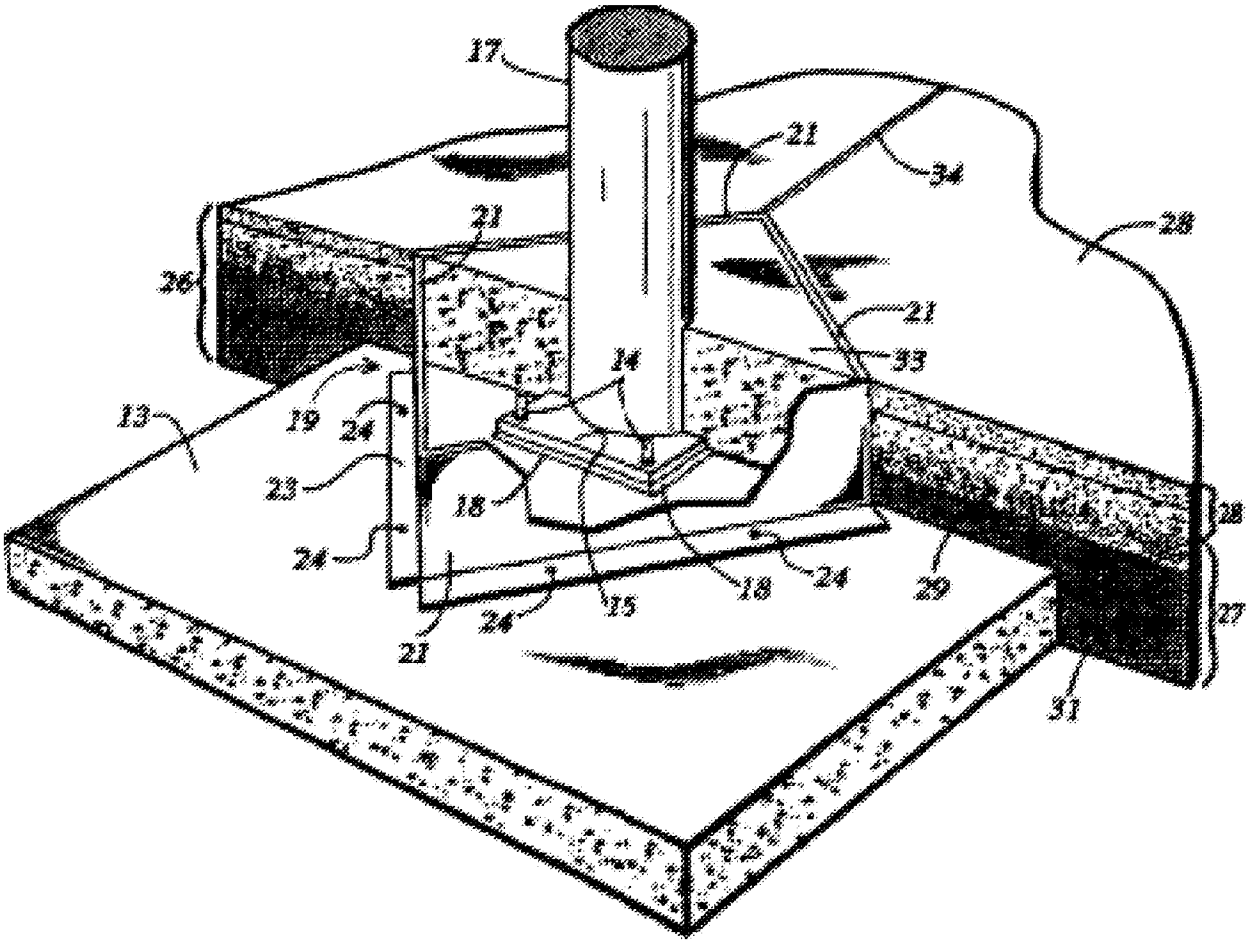
FIG 1 (Prior Art)
FIG. 1. is an isometric partially cut-away view of a prior art isolation pocket form within a concrete slab floor.

FIG. 1 illustrates a prior art apparatus and method for forming isolation pockets in a poured concrete slab floor. As detailed above, a concrete footing 13 is poured into the ground 31 and allowed to cure. A support column 17 is anchored to the footing with anchor bolts 14 and extends them upwardly therefrom. A box-shaped stay-in-place isolation pocket form 19 is constructed on the footing 13 surrounding the base of the support post 17. The floor is then prepared with compacted aggregate. Concrete 33 is also poured in the isolation form 19 surrounding the support post 17.

As the concrete floor slab as it cures, shrinks, and moves, stresses tend to become concentrated at the corners of the box-shaped isolation pockets. This causes cracks to radiate from these locations. To control the direction of these cracks, crack control joints 34 are cut or scored in the floor slab extending between the corners of the isolation pockets. These crack control joints direct cracks along the joints where they are much less unsightly than if allowed to advance randomly across the floor slab. As mentioned above however, these prior art isolation pocket techniques give rise to problems when pouring floor slabs using modern crack resistant concretes. The corners of box-shaped isolation pockets still tend to concentrate stress and cracks can still form at isolation pocket corners and radiate outwardly therefrom.

Figure 6:
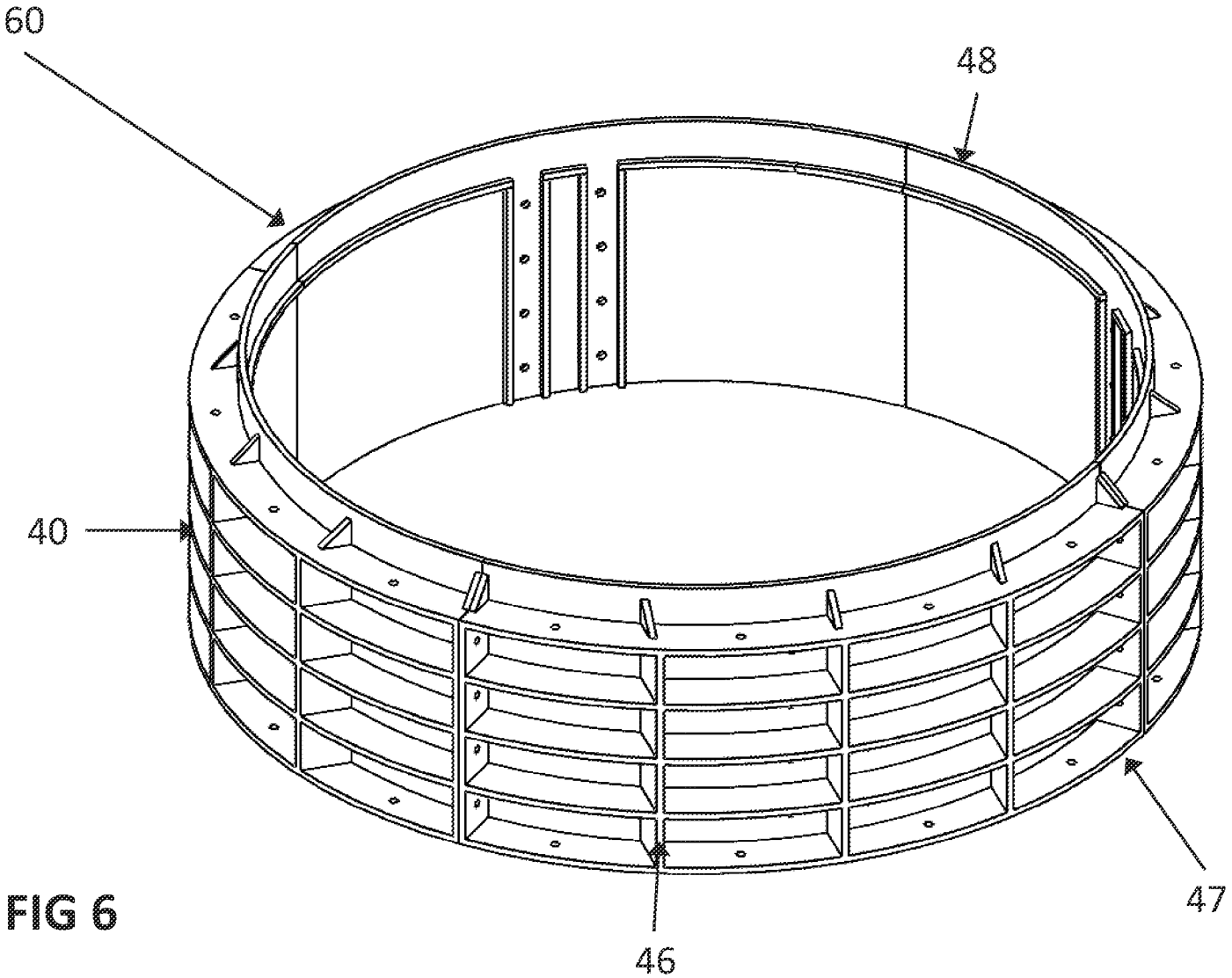
FIG. 6. is an isometric view of the entire proposed crack-resistant slab radial isolation pocket assembly in a standard cylindrical configuration, comprised of four quarter-round parts.
Figure 7:
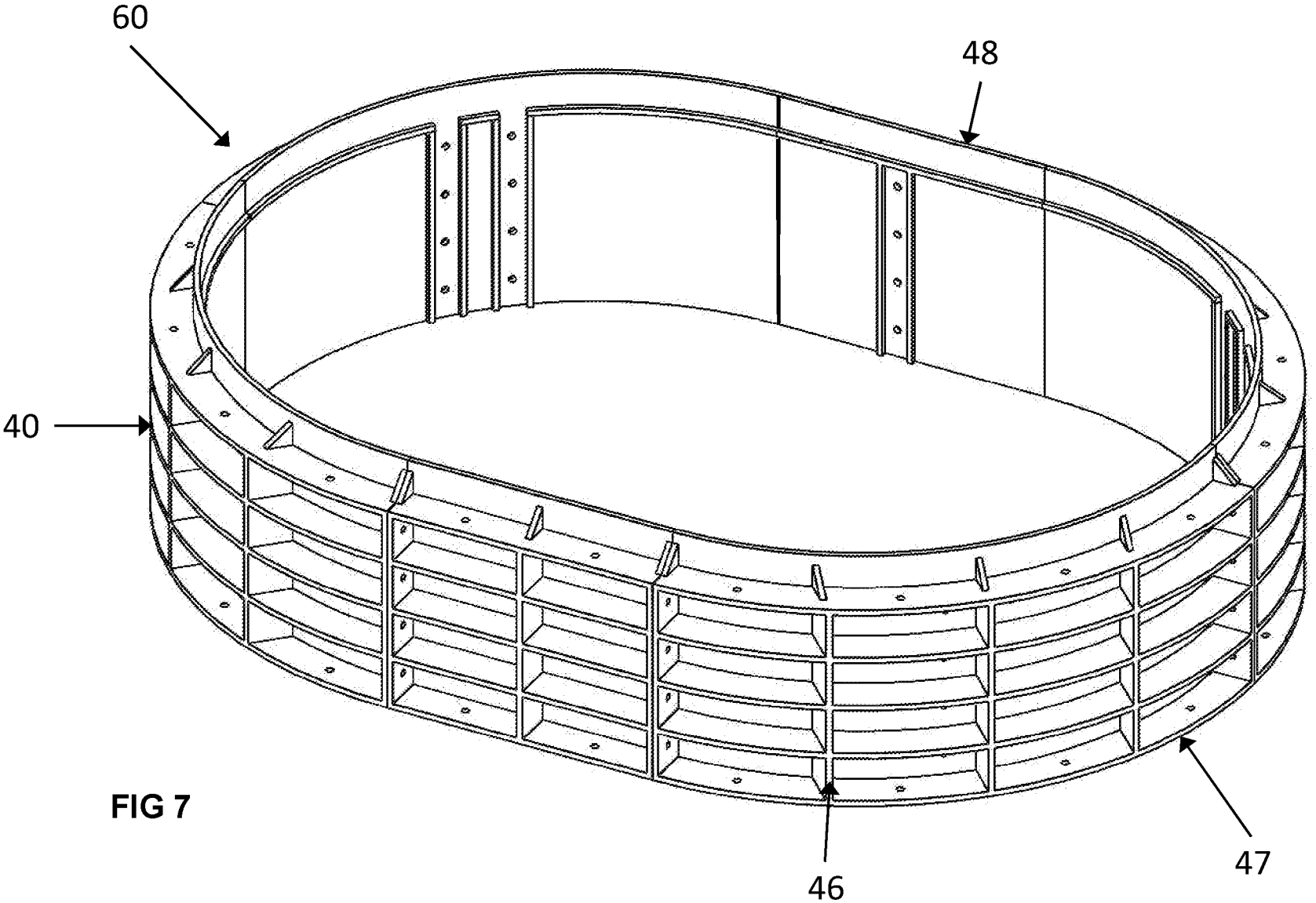
FIG. 7. is an isometric view of the entire proposed crack-resistant slab radial isolation pocket assembly in a "racetrack" style configuration, comprised of four quarter-round parts and two extension pieces.

FIGS. 6 and 7 illustrate an exemplary embodiment of an isolation pocket form according to the invention, while FIG. 2, FIG. 3, FIG. 4, and FIG. 5 illustrate the components which when assembled form the invention. The isolation pocket form 60 comprises a curved barrier section 42 having a base 47 and a top rim 48. Triangular gussets 41 on the exterior side of the barrier section support the top rim. Axially extending supporting ribs 46 project from the curved barrier section 42. A plurality of connecting ribs 40 encircle the curved section, and optional linear extension, and these rings connect the support ribs 46 together. The support ribs 46 and connecting ribs 40 strengthen and provide rigidity to the inner core, and are equidistant to provide nominal measurement lines for cutting in order to customize final size. They also provide strength and rigidity to prevent the isolation pocket form from collapsing or deforming under the substantial forces and pressures it experiences as aggregate is compacted and concrete is poured around the form. In the illustrated embodiments, the support ribs 46 and connecting ribs 40 are formed on the outer peripheral surface of the curved section 42 and project outwardly. It will be understood, however, that the connecting ribs 40 and axially extending support ribs 46 might also be formed on the inside surface of the curved barrier section 42 and project inwardly.

Preferably, the isolation pocket(s) are formed of a molded plastic material such as Polyvinyl Chloride (PVC), Acrylonitrile Butadiene Styrene (ABS), Polyethylene terephthalate (PET), Polypropylene (PP), Polyactic Acid (PLA), High Density Polyethylene (HDPE), Linear Low Density Polyethylene (LLDPE), or any other industry common plastic and/or thermoplastic material. Regardless of the plastic chosen, the exposed surfaces should be sufficiently smooth that cured concrete can slide along these surfaces without significant resistance. In this way, relative movement between the floor slab and the isolation pocket is accommodated without cracking or flaking the concrete surrounding the pocket.

For economy of shipping and handling, the form is constructed from several barrier sections.

For example, in the embodiments of FIGS. 2-7, the isolation pocket form is constructed from mirror-image quarters, and straight extensions. It will be understood, however, that the curved parts might also be molded into mirrored halves, or eighths. Standard fasteners (not shown)

such as nuts and bolts are installed at the mating flange connection holes 44, to secure the sections of the form together before pouring of the concrete.

Figure 8:
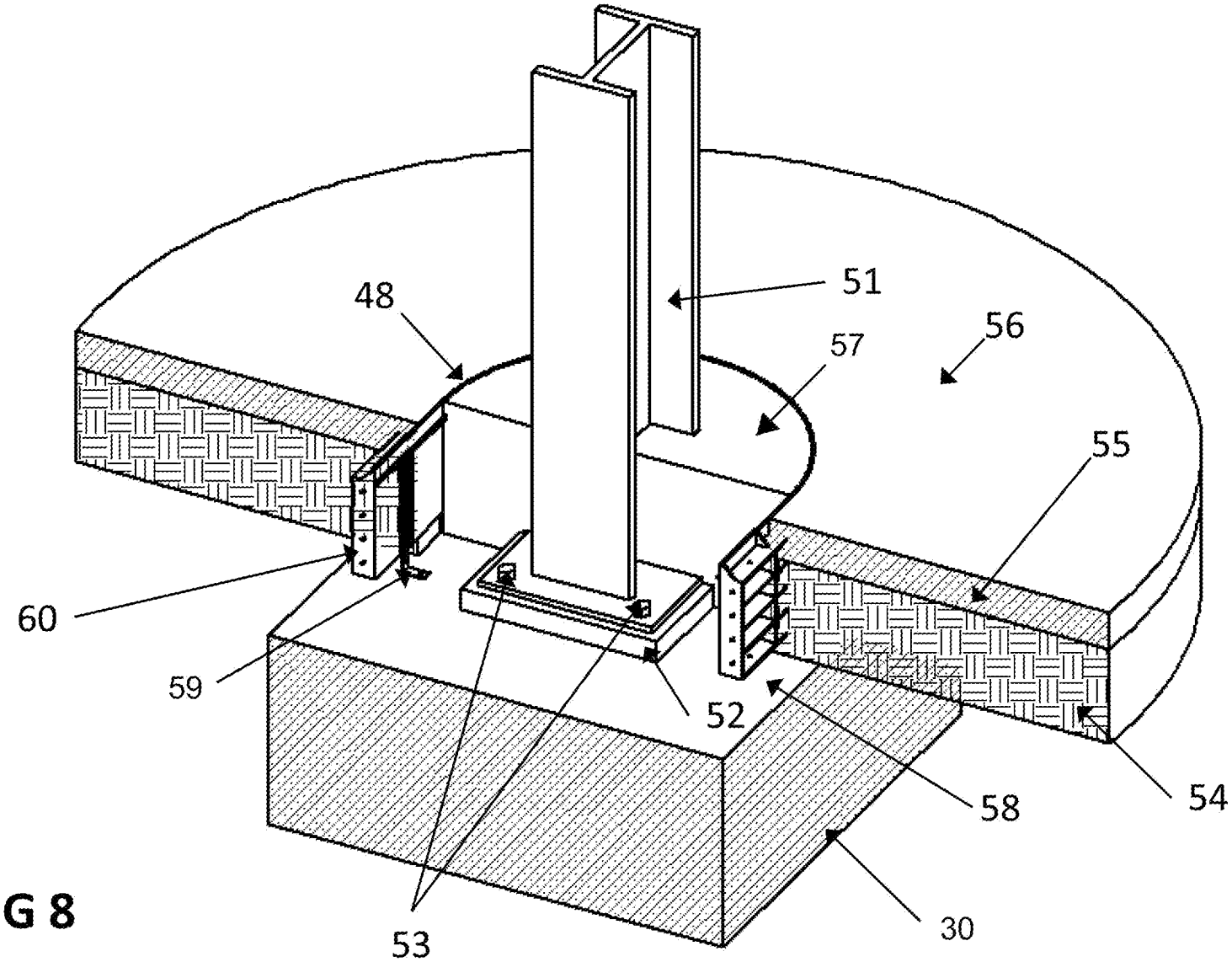
FIG. 8 is an isometric partially cut-away view of the proposed crack-resistant isolation pocket form embedded within a concrete floor.

As shown in FIG. 8, metal leveling brackets 59 which serve as feet can be installed and secured by fasteners (not shown), passing through holes 43, to the leveling bracket channel guide 50 on the pocket form in order to level the pocket form for concrete pouring. The feet are supported on the interior surface of the sections, and can be adjusted vertically.

Figure 9:
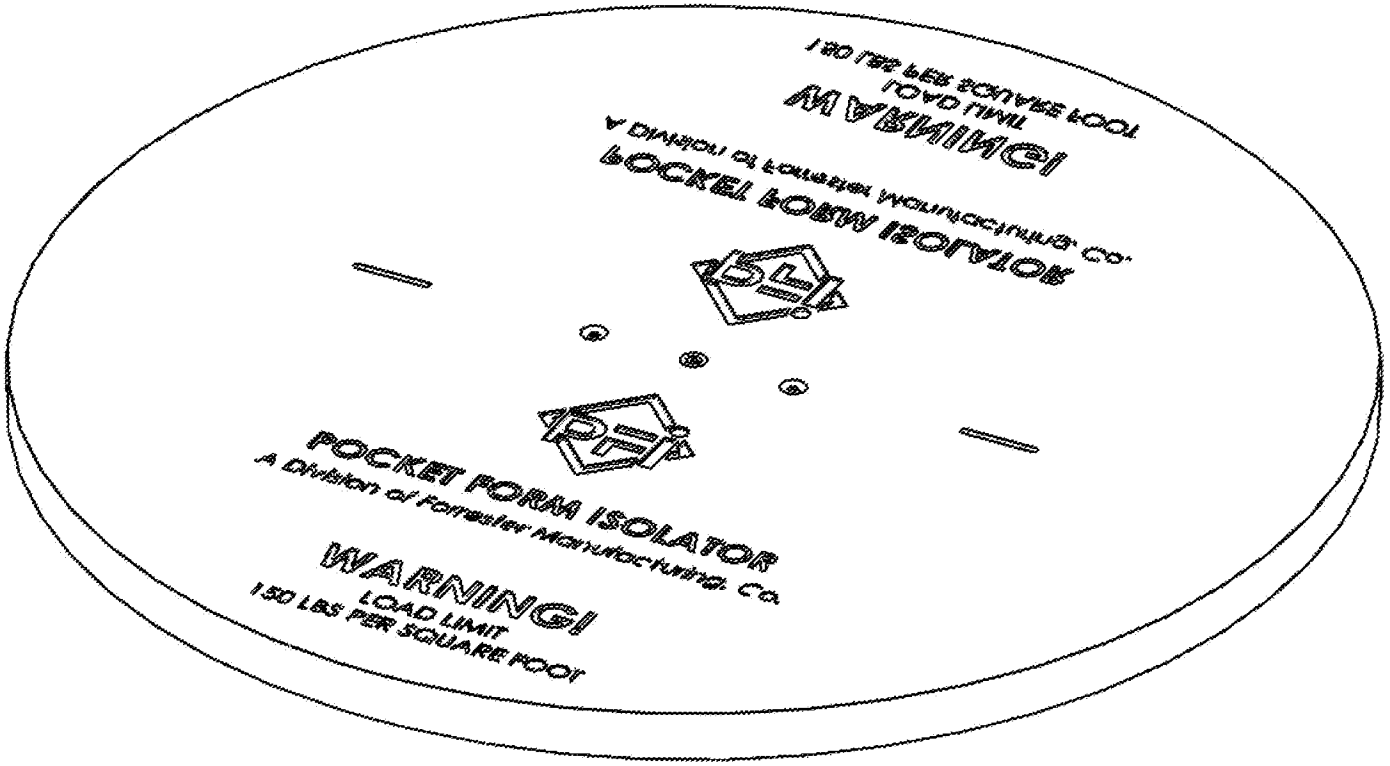
FIG. 9 is an isometric view of a lid for the form.

A small horizontal ledge 49 is formed on the interior surface of each section to support a lid. Use of a lid results in a seamless transition in elevation from the slab surface to the pocket form isolator. If the form is circular, the round lid of FIG. 9 can be used; lids of other shapes can be made for non-circular forms.

Figure 2:
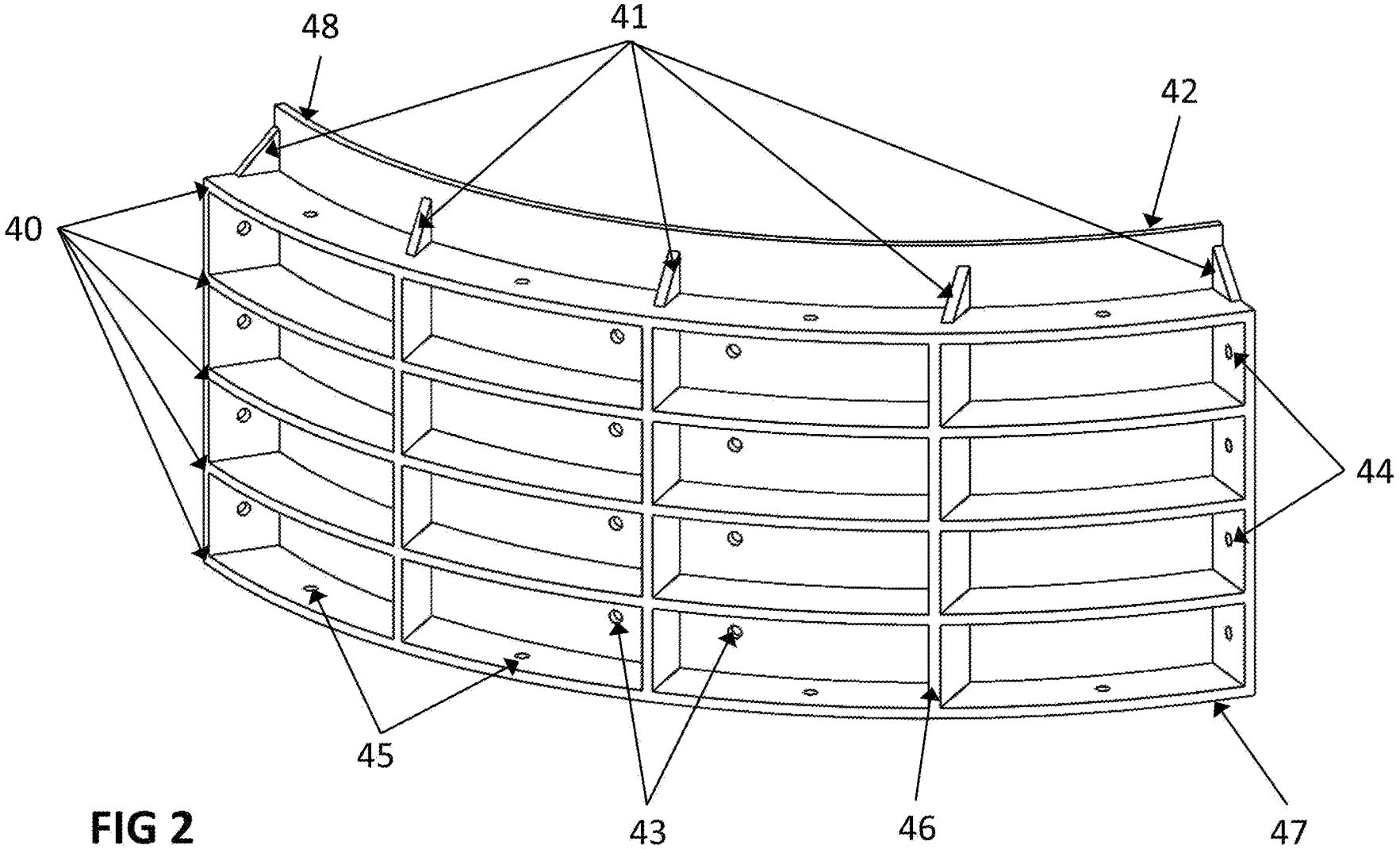
FIG. 2. is a frontward facing dimetric view of the proposed quarter-round crack-resistant slab radial isolation pocket.
Figure 3:
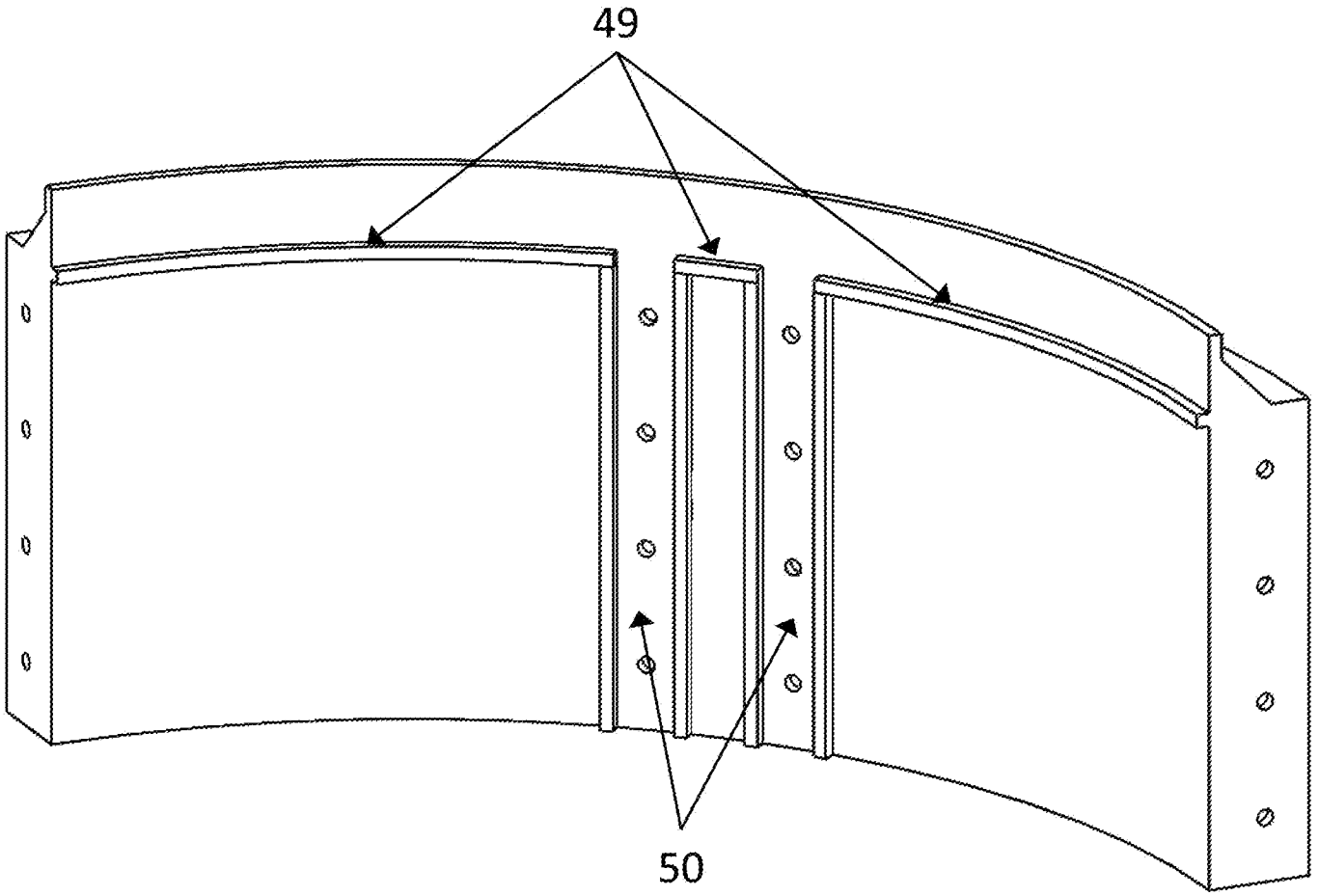
FIG. 3. is a rearward facing dimetric view of the proposed quarter-round crack-resistant slab radial isolation pocket.
Figure 4:
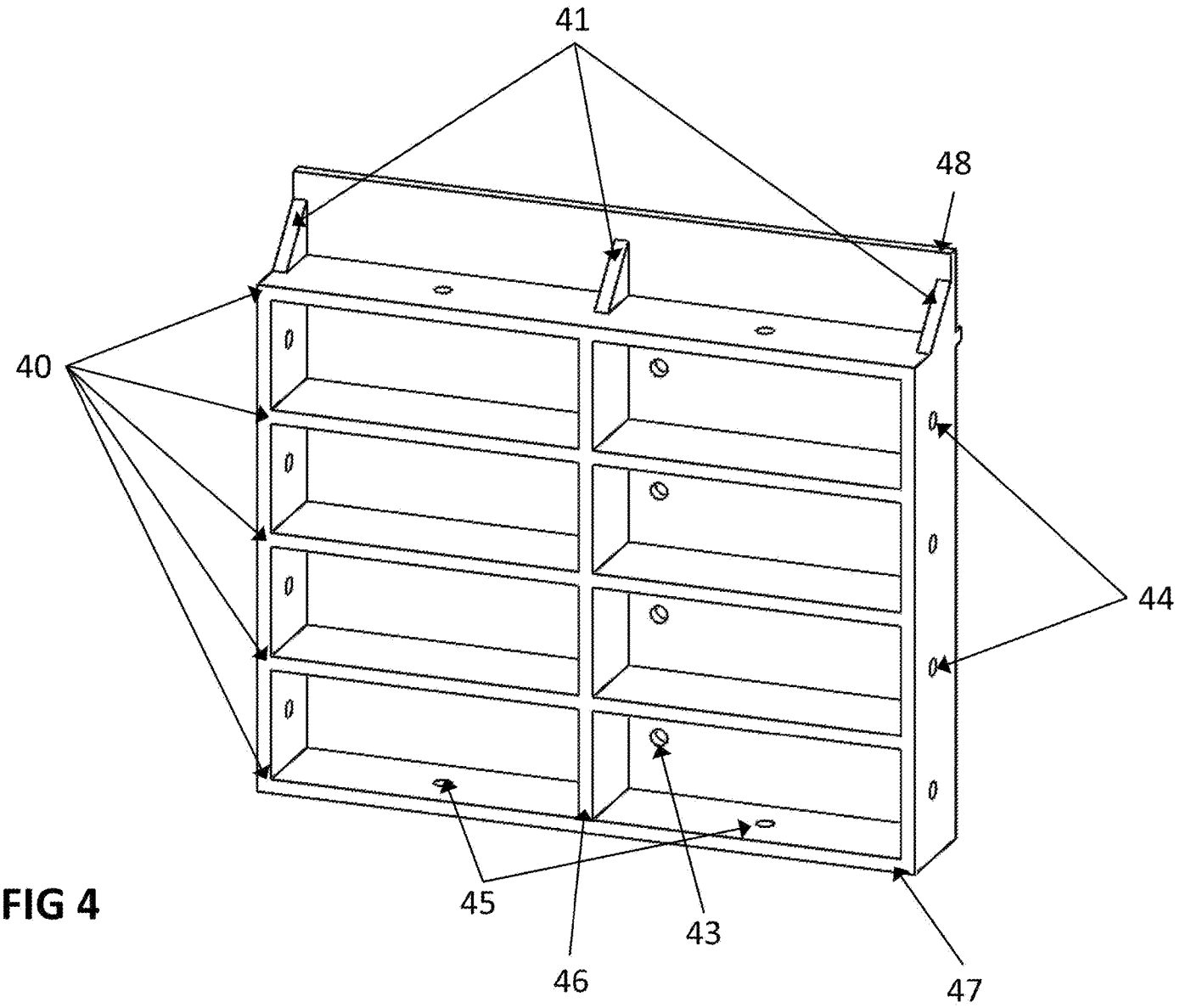
FIG. 4. is a frontward facing dimetric view of the proposed linear extension to be used in tandem with the radial crack-resistant slab isolation pocket.
Figure 5:
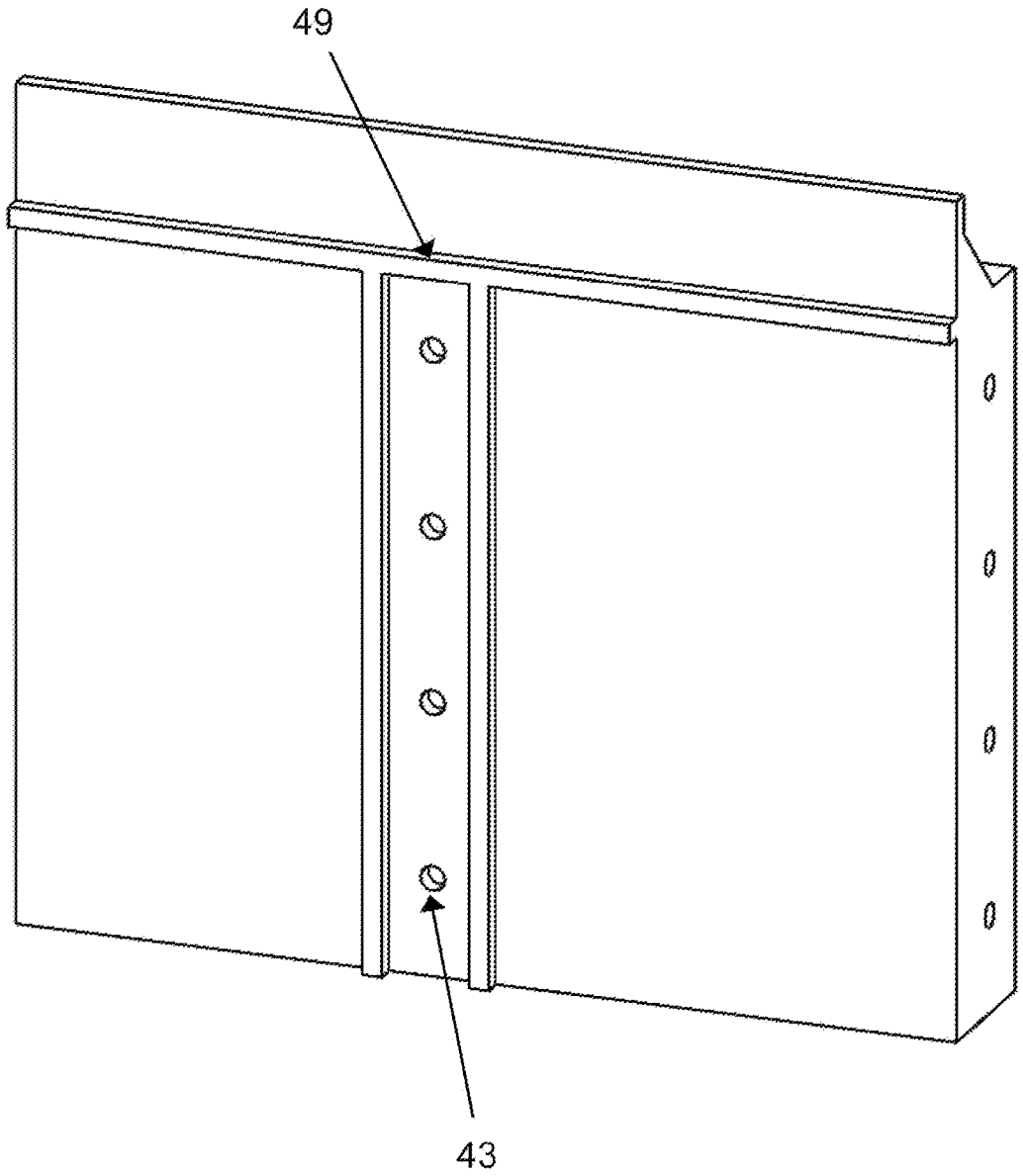
FIG. 5. is a rearward facing dimetric view of the proposed linear extension to be used in tandem with the radial crack-resistant slab isolation pocket.

As shown in FIGS. 2 and 4, the crack-resistant pocket form isolator is equipped with mating holes 45 located on the base 47. If additional height is needed, due to deep footing requirements or thick slab demands, an additional part can be inverted and attached directly to the base 47 of the pocket form isolator 60 to provide additional height.

FIG. 8 is an isometric partially cross-sectional and partially cut-away view showing one configuration of a crack resistant isolation pocket form according to the invention embedded in a completed concrete floor slab 55. A concrete footing 30 is poured in the ground and is sufficiently large and thick to support the weight that will be borne by the support post 51. In this embodiment, the support post 51 is attached to a base plate 52. The base plate 52 in turn is secured to the footing 30 with anchor bolts and corresponding nuts 53 so that the support post extends vertically upwardly from the footing 30.

In FIG. 8, the crack-resistant isolation pocket form 60 is shown assembled and resting on the concrete footing 30, leveled by the metal leveling brackets 59, surrounding the post 51, its base plate 52, and anchor bolts and nuts 53. Aggregate 54 has been leveled and compacted around the isolation pocket form to create a solid foundational base upon which the concrete floor slab 55 can rest. Like the aggregate, the concrete floor slab 55 is poured against the isolation pocket form 60 and preferably extends up to an exposed concrete surface 56 that is co-extensive or level with the top rim 48 of the form 60. In this example the concrete comprises a formulation and additives that render the cured slab highly resistant to developing large unsightly cracks.

Concrete 57 also is poured into the interior of the isolation pocket form up to its top rim 48. This forms a concrete plug that surrounds the support post and rests on the upper surface 58 of the concrete footing 30. The exposed surface of the floor slab thus appears to be substantially unitary and appears to extend completely to the bases of support posts. However, the concrete plugs formed around the posts as well as the footings and posts themselves are physically isolated from the larger floor slab. Accordingly, movement of the floor slab due to shrinkage or settling is not transferred to the support posts and vice-versa.

While it is preferable that the isolation pocket form be filled with concrete at the same time as the floor slab itself is poured, due to the design of the invention, the concrete can be poured in any of the following methods; interior first, exterior first, or simultaneous. Simultaneous pouring is preferable, since the cured concrete surrounding support posts is consistent in color and texture with the concrete floor slab as a whole. The top rims 48 of the isolation pocket forms may be slightly visible around the support posts but that is generally not objectionable. The isolation pocket forms also can be molded from a plastic that is grey or otherwise concrete colored to minimize the visibility of the rim 48, if desired. Should movement occur between the concrete floor slab and one or more of the support posts as a result of shrinkage or settlement, the footings and support posts are isolated from this movement by the embedded isolation pocket forms. The smoothness of the surfaces of the crack-resistant isolation pocket forms facilitates movement between the slab and the pocket without snagging or catching. Furthermore, since the isolation pocket forms are radially based, there are no sharp, or reentrant, corners formed in the concrete slab by the forms at which stresses can accumulate.

The result is that cracks in the slab do not begin at the isolation pockets and radiate outwardly therefrom. Crack control joints are thus not required to be cut or scored in the concrete slab due to the isolation pockets. The finished floor slab is smooth, clean, devoid of large unsightly cracks, and devoid of crack control joints. Even if small hairline cracks form in the slab, the formulation of the concrete ensures that large unsightly cracks do not develop. Further, the curved section design eliminate stress points where such cracks might otherwise be induced.

The invention has been described herein in terms of preferred embodiments and methodologies considered by the inventors to represent the best modes of carrying the invention. It will be understood, however, that additions, deletions, and modifications might well be made to the illustrated embodiments without departing from the spirit and scope of the invention claimed below.

We claim as our invention:

1. A pocket isolator form for placement around a footer before a concrete slab is poured, said isolator form comprising:

a plurality of interconnected barrier sections, wherein some of said barrier sections are curved quarter-round sections, each with a concave side facing the footer, such that:

the form has no sharp corner where the barrier sections meet one another, thus avoiding the creation of a sharp re-entrant corner in the concrete slab, the curved barrier section has a substantially smooth, concave interior surface and an exterior surface bearing reinforcing ribs, and said ribs comprising a plurality of axially extending supporting ribs and a plurality of connecting ribs, further comprising a vertically extending guide channel formed on said interior surface of said barrier section, a metal leveling bracket adjustably secured in said channel, and said bracket serving as a foot so that the form can be leveled before concrete is poured around the pocket isolator form.

2. The invention of claim 1, wherein at least one of the barrier sections is straight.

3. The invention of claim 1, wherein said curved barrier section has a constant radius of curvature.

4. The invention of claim 1, further comprising a horizontal ledge which is formed on said interior surface, for supporting a lid.

5. The invention of claim 1, further comprising fasteners for interconnecting the barrier sections to one another.

6. The invention of claim 1, wherein the barrier sections are assembled so as to form a closed pocket isolator form extending around said footer.

* * * * *